US006085418A

United States Patent [19]

Matsubara et al.

[11] Patent Number: 6,085,418

[45] Date of Patent: Jul. 11, 2000

[54] APPARATUS FOR AND METHOD OF SIZING HELICAL GEARS

[75] Inventors: Sadao Matsubara; Noboru Sugiura, both of Kumamoto, Japan

[73] Assignee: Honda Giken Kogyo Kabushiki Kaisha, Tokyo, Japan

[21] Appl. No.: 09/141,373

[22] Filed: Aug. 27, 1998

[30] Foreign Application Priority Data

Aug. 27, 1997 [JP] Japan ..... 9-230168

[51] Int. Cl.[7] ..... B23F 19/00; B23D 37/10

[52] U.S. Cl. ..... 29/893.35; 409/60

[58] Field of Search ..... 29/893.34, 893.35, 29/893.36, 833.33; 409/58, 59, 60; 72/334, 356, 359, 364, 355.2

[56] References Cited

U.S. PATENT DOCUMENTS

| | | | |
|---|---|---|---|
| 2,674,924 | 4/1954 | Nielsen | 409/60 |
| 3,370,450 | 2/1968 | Scheucher | 72/355.2 |
| 3,459,103 | 8/1969 | Birch | 409/60 |
| 3,842,646 | 10/1974 | Kuhn | 72/359 X |
| 5,746,085 | 5/1998 | Haradahl | 29/893.34 X |

FOREIGN PATENT DOCUMENTS

| | | | |
|---|---|---|---|
| 1082507 | 7/1980 | Canada | 409/59 |
| 82944 | 4/1986 | Japan | 72/356 |
| 2-63634A | 3/1990 | Japan . | |

*Primary Examiner*—William Briggs
*Attorney, Agent, or Firm*—Birch, Stewart, Kolasch, & Birch, LLP

[57] ABSTRACT

The present invention provides a tooth profile sizing apparatus and method for helical gears which are capable of shortening a cycle time for the sizing process to improve productivity and to allow production thereof at a low equipment cost. In order to accomplish the above object, the sizing apparatus comprises a lower punch 7 for carrying thereon a gear blank W, which is formed with a rotatable first lower punch 7*a* and a non-rotatable second lower punch 7*b*. A sizing die 8 is formed to be rotatable and vertically movable with its inner peripheral teeth s in engagement with the outer peripheral teeth p of the first lower punch 7*a*. An upper punch 9 for pressing the gear blank W into the sizing die 8 is formed with a rotatable first upper punch 9*a* and a non-rotatable second upper punch 9*b*. The upper punch 9 moves in the vertical direction and is provided on its outer circumferential surface with outer peripheral teeth q.

5 Claims, 6 Drawing Sheets

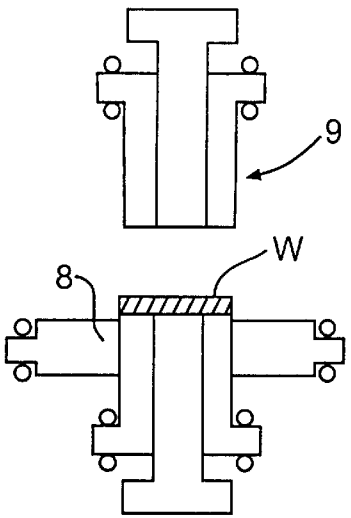
FIG. (5D)
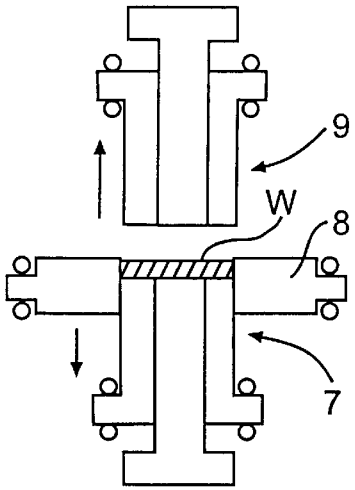
FIG. (5C)
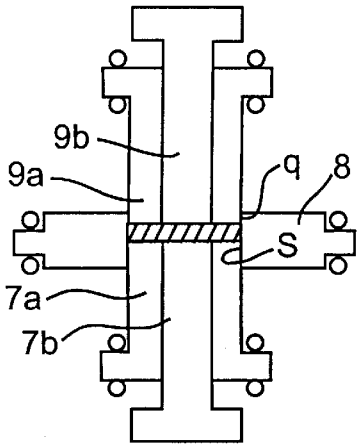
FIG. (5B)
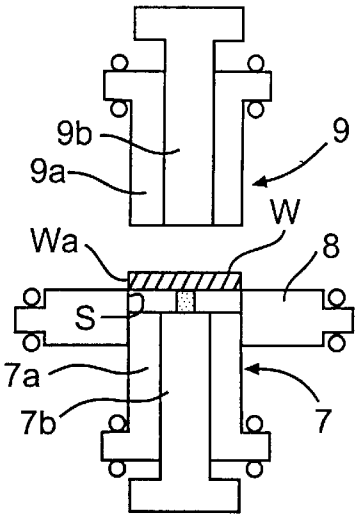
FIG. (5A)

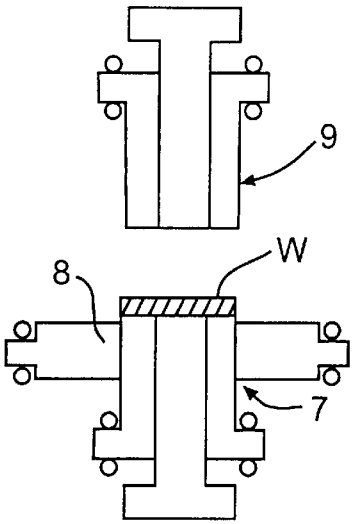
FIG. (6D)
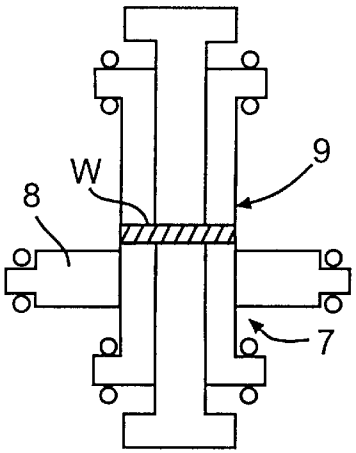
FIG. (6C)
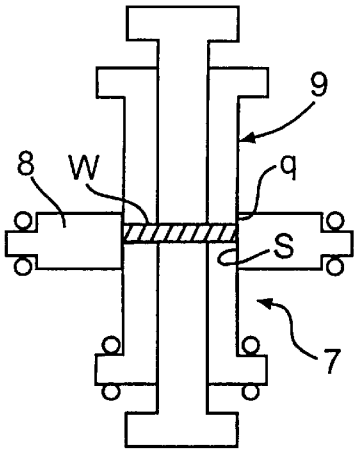
FIG. (6B)
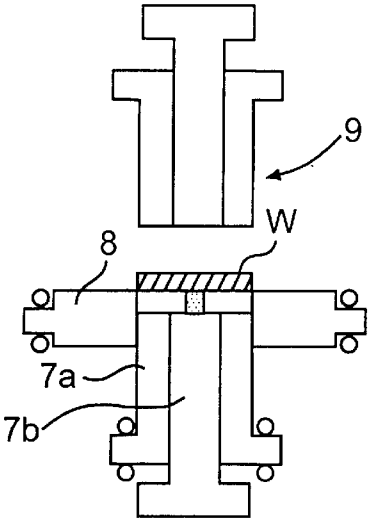
FIG. (6A)

APPARATUS FOR AND METHOD OF SIZING HELICAL GEARS

BACKGROUND OF THE INVENTION

1. Field of the Invention

The present invention relates to the art of helical gear sizing and more particularly to an apparatus for and a method of sizing teeth profiles of helical gears that are in the form of a sintered powdery material, for example, for improving the precision or the like of the teeth profiles of the helical gears.

2. Description of the Prior Art

Hitherto, as a tooth profile sizing apparatus for sizing the teeth of helical gears having a non-linear tooth trace, for example, there has been known the technology as disclosed in Japanese patent publication No. H02-63634. The apparatus comprises an inner lower die on which a gear blank is disposed, an outer lower die adapted to engage or mesh with the teeth of the gear blank to size the gear profile thereof, an upper die for pressing the gear blank inwardly of the outer lower die, and a rotary driving mechanism adapted to rotate the outer lower die in synchronization with the descending movement of the upper die when the gear blank is pressed by the upper die, wherein the gear blank is pressed into and sized by the outer lower die in a compressed condition between the upper die and the inner lower die. When removing or taking the gear blank out of the dies, the upper die moves upwardly and the piston rod is pushed up to drive the inner lower die upwardly to thereby release the gear blank from the outer lower die. Then, the gear blank is pushed upwardly and released from the inner lower die by a knock-out pin.

The tooth profile sizing apparatus as described above, however, requires a long cycle time for the sizing process, and it especially takes much time until the sized product can be removed. Further, the construction for removing the product is comparatively complicated and incurs a large equipment cost.

SUMMARY OF THE INVENTION

It is, therefore, an object of the present invention to provide an apparatus for and a method of sizing helical gears which enable a cycle time for the sizing process to be shortened by saving time when removing the sized product, while simplifying the construction for removing the product so as to reduce equipment costs.

With a view to accomplishing the object described above, an apparatus for sizing the teeth profiles of helical gears according to the present invention comprises a lower punch on which is placed a gear blank, a vertically movable upper punch for pressing the gear blank downward, and a sizing die adapted to have inner peripheral teeth thereof engaged with the gear blank pressed by the upper punch to size the teeth profiles of the gear blank, wherein the lower punch comprises a first lower punch and a second lower punch, the second lower punch non-rotationally carrying the gear blank placed thereon and the first lower punch being arranged axially rotatable around the second lower punch and provided with outer peripheral teeth thereon, wherein the sizing die is axially rotatable and vertically movable while the inner peripheral teeth thereof are engaged with the outer peripheral teeth of the first lower punch, and wherein the upper punch is arranged axially rotatable and provided with the outer peripheral teeth which come into engagement with the inner peripheral teeth of the sizing die.

In another aspect of the present invention, a method of sizing the teeth profiles of helical gears comprises the steps of non-rotationally positioning a gear blank having teeth carried on a lower punch, sizing the teeth profiles of the gear blank by pressing the gear blank downward with an upper punch into a sizing die while having the teeth of the gear blank and the outer peripheral teeth of the upper punch engaged with the inner peripheral teeth of the sizing die, releasing upon termination of the sizing step the sizing die from engagement with the upper punch and the gear blank by rotating and lowering the sizing die, and moving the upper punch to remove the gear blank.

With this construction, an interlocking device such as the conventional rotary driving mechanism will not be required thus making the equipment simple and low-priced in construction and the time necessary from sizing to removing the product may be shortened to improve the production cycle.

In still another aspect of the present invention, an apparatus for sizing the teeth profiles of helical gears comprises a lower punch on which is placed a gear blank, a vertically movable upper punch for pressing the gear blank downwards, and a sizing die adapted to have inner peripheral teeth thereof engaged with the gear blank pressed by the upper punch to size the teeth profiles of the gear blank, characterized in that the lower punch comprises a first lower punch and a second lower punch, the second lower punch non-rotationally carrying the gear blank placed thereon and the first lower punch being arranged axially rotatable around the second lower punch and provided with outer peripheral teeth thereon, such that the sizing die is axially rotatable and vertically movable while the inner peripheral teeth thereof engage the outer peripheral teeth of the first lower punch, and such that the upper punch comprises a non-rotatable second upper punch, with a first upper punch being arranged axially rotatable around the second upper punch in which the first upper punch is provided with the outer peripheral teeth which engage the inner peripheral teeth of the sizing die.

In a further aspect of the present invention, a helical gear sizing method comprises the steps of positioning non-rotationally a gear blank carried on a lower punch, sizing the teeth profiles of the gear blank by pressing the gear blank downward with an upper punch into a sizing die while having the teeth of the gear blank and the outer peripheral teeth of the upper punch engaged with the inner peripheral teeth of the sizing die, releasing upon termination of the sizing step the upper punch and the sizing die from engagement with the gear blank while rotating the upper die and the sizing die so as to move the upper die upward and the sizing die downward, and removing the gear blank from the lower punch.

This apparatus is different in construction from the first described apparatus in that the upper punch has a rotational first upper punch instead of a non-rotational upper punch as described in the first apparatus. When the sizing process is conducted with the rotational upper punch according to the method described herein, the removal of the finished gear may be carried out more rapidly. Namely, when the upper punch is constructed to be non-rotational, the upper punch is kept, at the end of the sizing step, in engagement with the inner peripheral teeth of the sizing die. Thus, the upper punch can not rise up and the gear cannot be removed unless the sizing die is rotated and moved downward so as to release the upper punch from the engagement with the inner peripheral teeth thereof.

Therefore, the first upper punch of the upper punch is formed to be rotatable in such a manner that, upon termination of the sizing step, the upper punch may be moved upward substantially at the same time as the downward movement of the sizing die, whereby the time for removing the gear is shortened.

Preferably, a phase adjusting device is provided between the first upper punch and the sizing die or between the first upper punch and the first lower punch so as to adjust the relative phase between them when they return to their original positions. When the first upper punch moves downward in accordance with rotation of the first upper punch and the sizing die, it is difficult for a smooth sizing to take place if a phase difference develops between the outer peripheral teeth of the first upper punch and the inner peripheral teeth of the sizing die. Accordingly, the phase adjusting device is provided to angularly realign respective phases of the outer peripheral teeth of the first upper punch and of the inner peripheral teeth of the sizing die to their original positions, thereby adjusting these phases into a relatively aligned relationship at the time of sequential downward movement of the upper punch. Herein, since the inner peripheral teeth of the sizing die are engaged with the outer peripheral teeth of the first lower punch, a similar effect may be obtained if the relative phase between the first lower punch and the first upper punch is adjusted into an aligned relationship.

The above and other objects and the attendant advantages of the present invention will become apparent by reference to the following detailed description when considered with the accompanying drawings.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIGS. 5(A), (B), (C) and (D) are operation explanatory views of the sizing apparatus in accordance with the first embodiment; and FIGS. 6(A), (B), (C) and (D) are operation explanatory views of the sizing apparatus in accordance with the second embodiment.

DETAILED DESCRIPTION OF THE PREFERRED EMBODIMENTS

Figure 1:
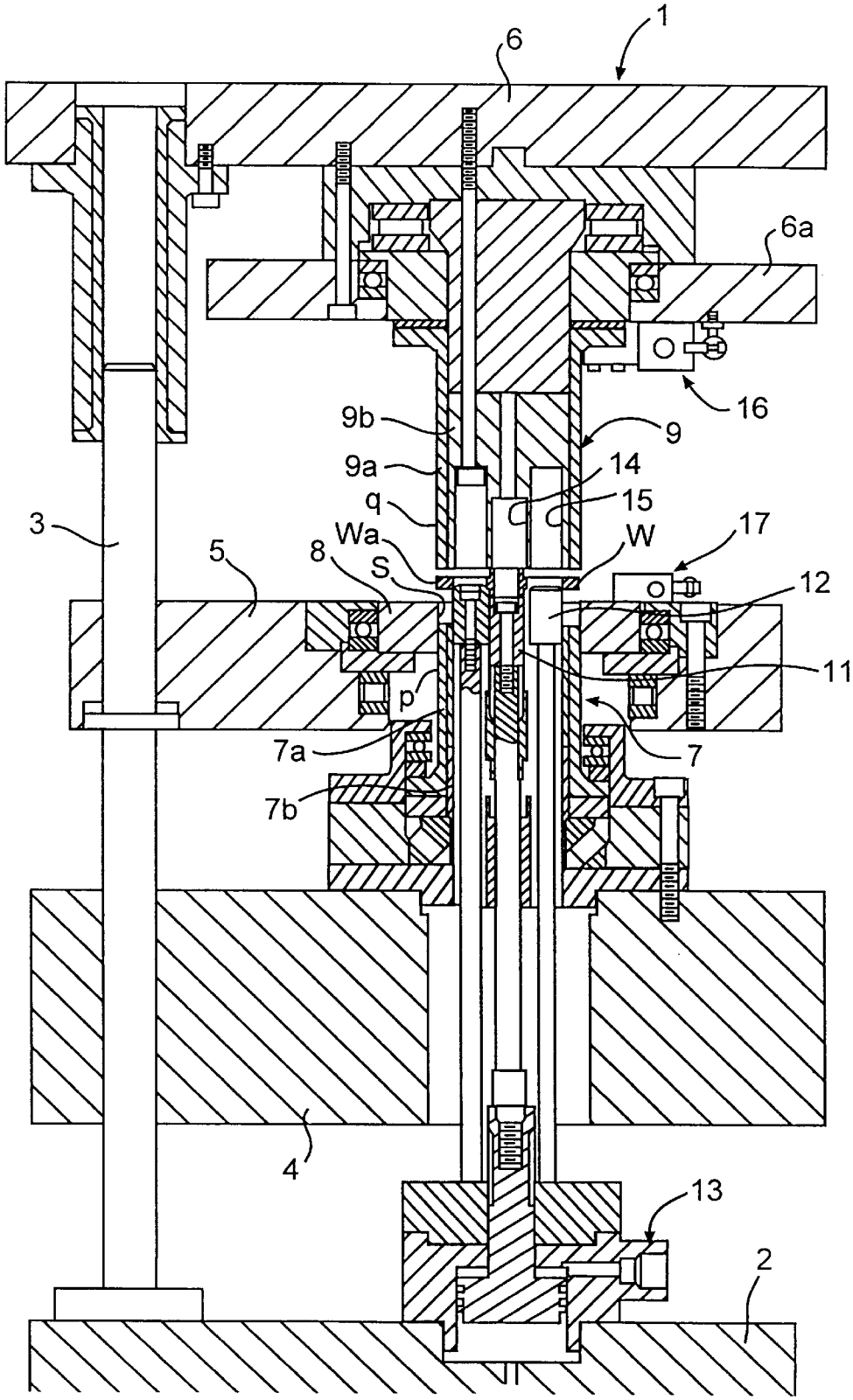
FIG. 1 is a cross sectional view of a first embodiment according to the present invention, illustrating an initial state of a sizing apparatus in which a gear blank is placed in a set position.
Figure 2:
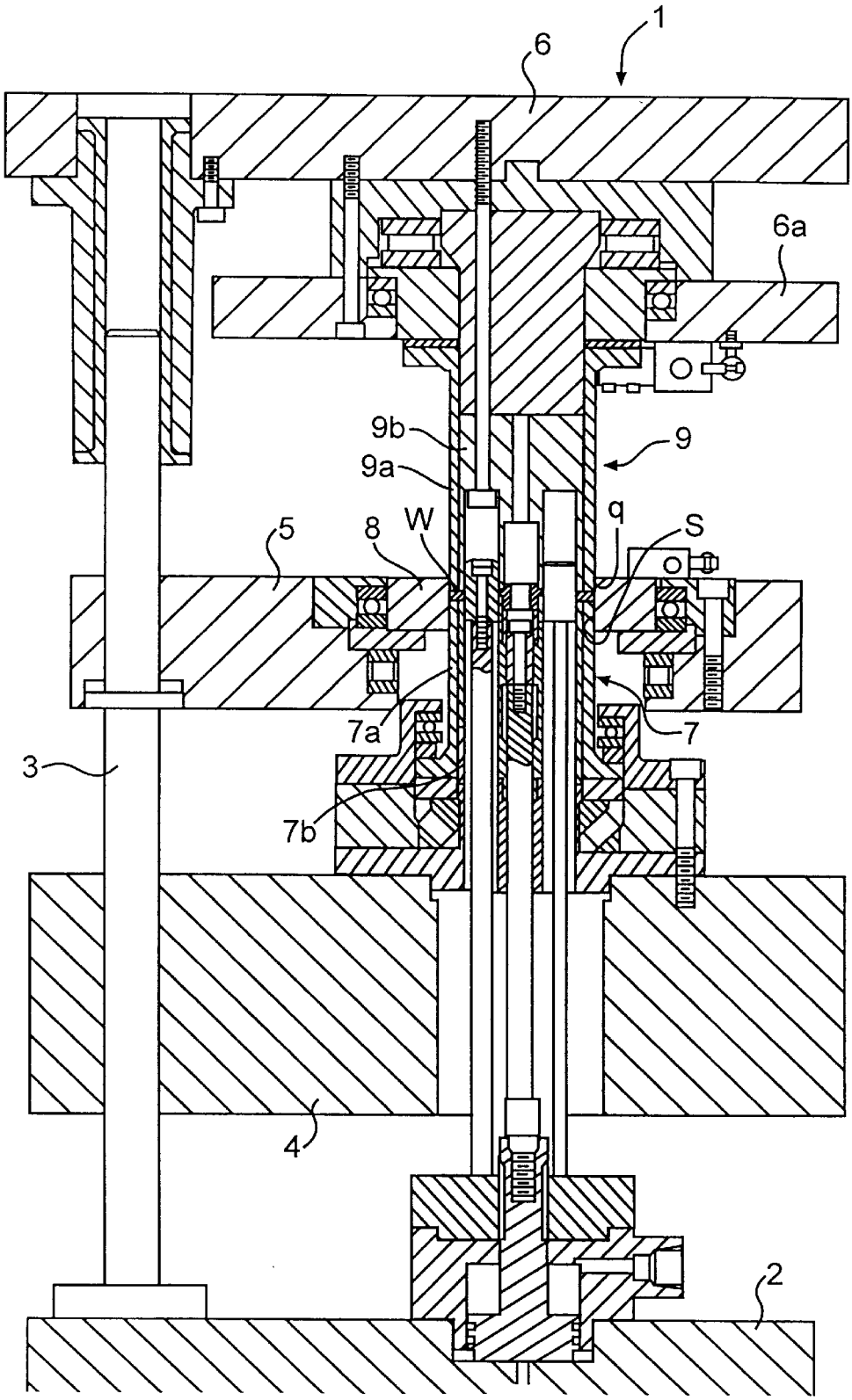
FIG. 2 is a cross sectional view of the first embodiment, illustrating a state soon after a sizing step is carried out.

The preferred embodiments of the present invention will be described hereunder with reference to the accompanying drawings, wherein FIG. 1 is a sectional view of the first embodiment of a sizing apparatus according to the present invention, in which a gear blank is in an initial set position; and FIG. 2 is a similar view of the first embodiment, illustrating the situation soon after a sizing step is carried out.

The sizing apparatus 1 according to the present invention is constructed as a tooth profile sizing apparatus for improving the precision of teeth profiles, the surface roughness of teeth, or the like, with respect to a gear blank W in the form of a sintered powdery material. As shown in FIG. 1, the apparatus 1 comprises a base 2, a guide post 3 of the base 2, a lower plate 4 slidably mounted on the lower position of the guide post 3, a die holder 5 slidably mounted on the intermediate portion of the guide post 3, and an upper plate 6 slidably mounted on the upper portion of the guide post 3. A lower punch 7 is carried on the lower plate 4 or the like. A sizing die 8 is carried on the die holder 8, and an upper punch 9 is mounted on an upper punch plate 6*a* of the upper plate 6.

In the above-described construction, when the upper punch 9 moves downward against the gear blank W to press down the latter into the inside concave portion of the sizing die 8, the profiles of each of plural teeth Wa of the gear blank W is corrected or sized by the inner peripheral teeth s of the sizing die 8 as described hereinafter. The gear blank W is formed having a boss at the center portion thereof which has a through-hole for inserting and passing an axle therethrough. Surrounding this center through-hole, a plurality of openings are formed radially outwardly along the circumferential direction of the gear blank W. The teeth Wa are formed previous to the sizing process on the outer peripheral portion of the gear blank W.

The lower punch 7 is provided with a second lower punch 7*b* fixedly secured to the lower plate 4, and with a first lower punch 7*a* which is rotatably mounted on the outer circumferential surface of the second lower punch 7*b* in an axially aligned relationship. Inside of the second lower punch 7*b* there is provided a work set pin 11 which extends through the center of the second lower punch 7*b* to slide in the upward and downward directions. Also inside of the second lower punch 7*b* are a plurality of positioning pins 12, 12 which extend vertically around the work set pin 11 along the circumferential direction of the second lower punch 7*b* so as to be engageable into and to pass through the openings of the gear blank W. The work set pin 11 is fixed on the tip end of a rod of a cylinder unit 13 which is disposed on the base 2, thereby to move up and down in the vertical direction. The lower end of each of the plural positioning pins 12, 12 are also mounted on the base 2.

The outer circumferential surface of the first lower punch 7*a* is formed with helical outer peripheral teeth p, the pitch of which corresponds to the pitch of the teeth Wa of the gear blank W. The sizing die 8 is rotatably carried on the die holder 5 which is capable of moving up and down through the intermediary of an elevator device (not shown), and has inner peripheral teeth s formed to be engaged with the outer peripheral teeth p of the first lower punch 7*a*. The inner peripheral teeth s serve as reference teeth in the case of sizing the teeth Wa of the gear blank W.

The upper punch 9 has a first upper punch 9*a* and a second upper punch 9*b*. The second upper punch 9*b* is fixedly secured to the upper plate 6 and the first upper punch 9*a* is rotatably engaged with the outer peripheral surface of the second upper punch 9*b*. At a center portion of the bottom surface of the second upper punch 9*b* there is provided an engaging hole 14 for permitting the center boss portion of the gear blank W to be engaged therewith. Around the engaging hole 14, a plurality of recessed holes 15 are provided along the circumferential direction to engagingly receive the positioning pins 12, 12 of the lower punch 7. The outer peripheral surface of the first upper punch 9*a* is formed with helical outer peripheral teeth q, the pitch of which corresponds to the pitch of the teeth Wa of the gear blank W. The upper plate 6 is capable of moving up and down through the intermediary of an elevator device (not shown).

When the gear blank W is placed on the work set pin 11 of the lower punch 7 in the state seen in FIG. 1, the work set pin 11 moves down in a predetermined stroke under the operation of the cylinder unit 13 until the lower surface of the outer periphery of the gear blank W comes to be flush with the upper surface of the sizing die 8. In this condition, when the upper punch 9 moves down to make the lower surface thereof flush with the upper surface of the outer periphery of the gear blank W, the phases are previously adjusted to be registered with each other between the outer peripheral teeth q of the first upper punch 9*a*, the teeth Wa of the gear blank W, and the inner peripheral teeth s of the sizing die 8. Thereafter, the work set pin 11 further moves down in synchronization with the downward movement of the upper punch 9.

In order to register the phase of the outer peripheral teeth q of the first upper punch 9*a*, the phase of the teeth Wa of the gear blank W, and the phase of the inner peripheral teeth s of the sizing die 8 with each other, at the time the lower surface of the upper punch 9 goes down to the upper surface of the outer periphery of the gear blank W, a first phase adjusting device 16 is provided on the first upper punch 9*a* and a second phase adjusting device 17 is provided on the sizing die 8. The phasing of the gear blank W is performed when the gear blank W is placed on the work set pin 11, and the positioning pins 12, 12 are engaged with the corresponding openings of the gear blank W, in such a manner that the phase of the teeth Wa of the gear blank W is adjusted in alignment with the phase of the inner peripheral teeth s of the sizing die 8.

Figure 3A:
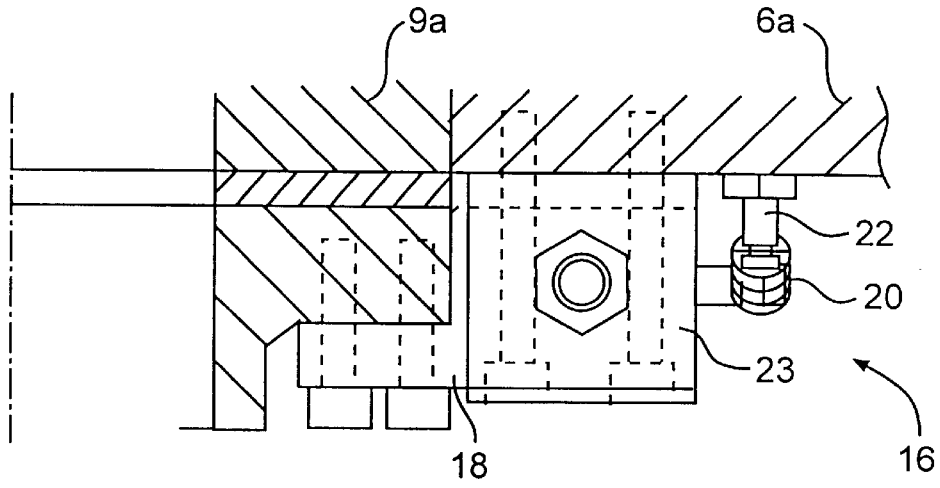
FIGS. 3(A) and (B) are explanatory views of a phase adjusting device for a first upper punch.
Figure 3B:
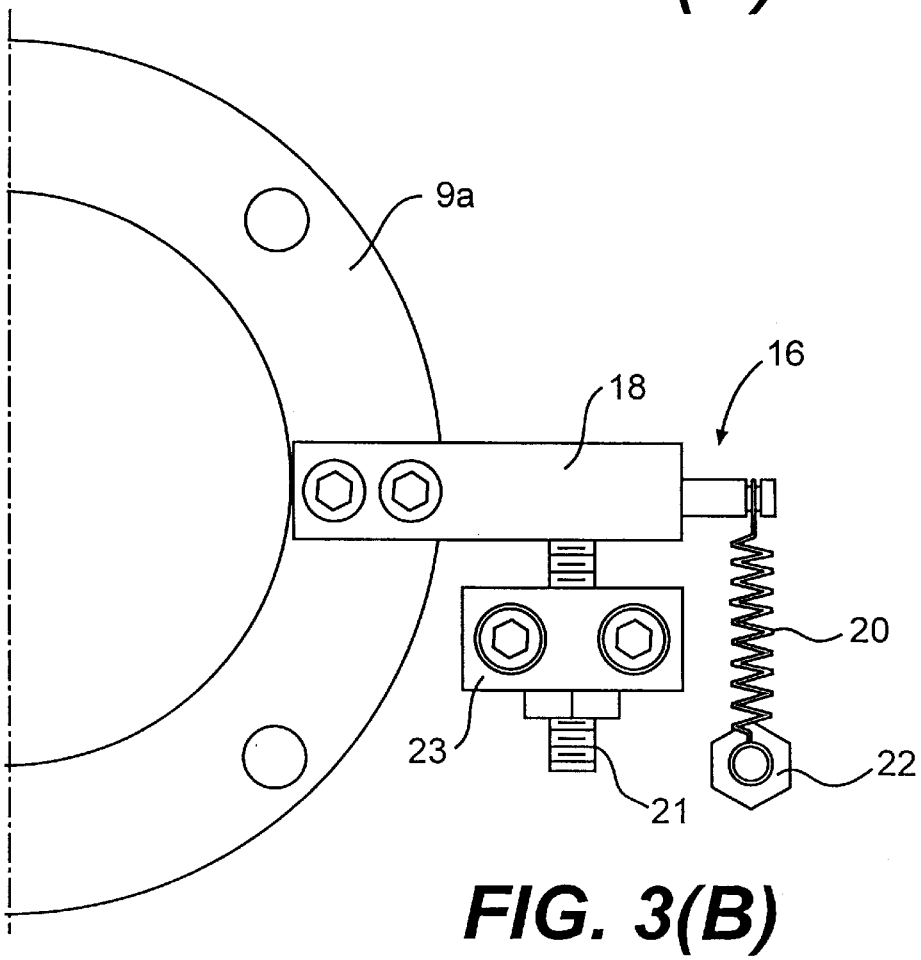

As seen in FIG. 3(A), which is a partial view in enlarged scale of FIG. 1, and in FIG. 3(B), which is a plan view thereof, the first phase adjusting device 16 comprises an engaging piece 18 mounted on the proximal end of the first upper punch 9*a*, a spring 20 is engaged at an end thereof on the tip end of the engaging piece 18 to bias the latter towards rotational direction of the first upper punch 9*a*, and a stopper pin 21 is adapted to control the position of the engaging piece 18. The other end of the spring 20 is engaged with a pin 22 anchored to the upper punch plate 6*a*. The stopper pin 21 is carried on a support member 23 mounted on the upper punch plate 6*a*. The biased force of the spring 20 is directed to function in a direction opposite to the direction of rotation of the first upper punch 9*a* which rotates in engagement with the inner peripheral teeth s of the sizing die 8 at the time as the descending movement of the upper punch 9, so that the spring 20 serves to return the phase of the first upper punch 9*a* to the initial position thereof when the upper punch 9 returns to its initial position upon termination of the sizing process.

Figure 4A:
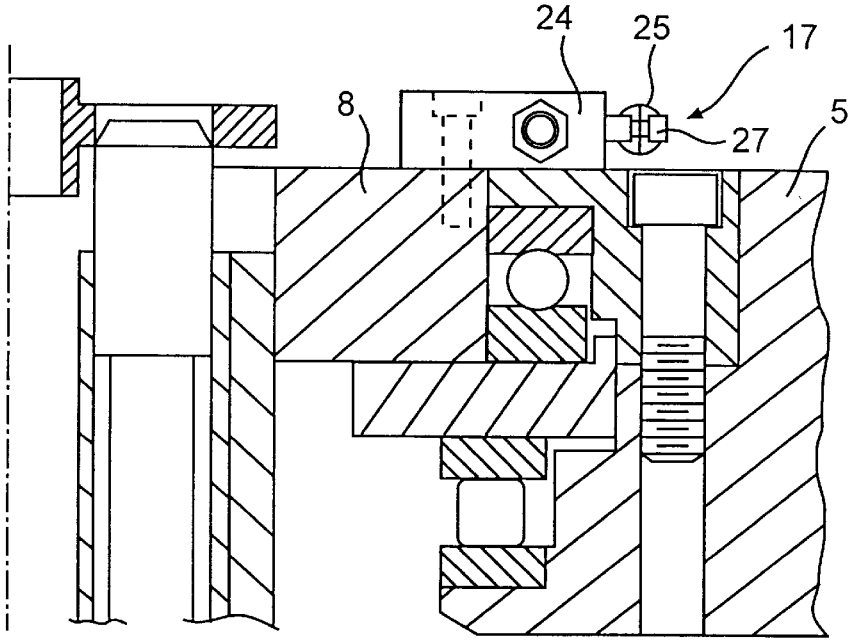
FIGS. 4(A) and (B) are explanatory views of a phase adjusting device for a sizing die.
Figure 4B:
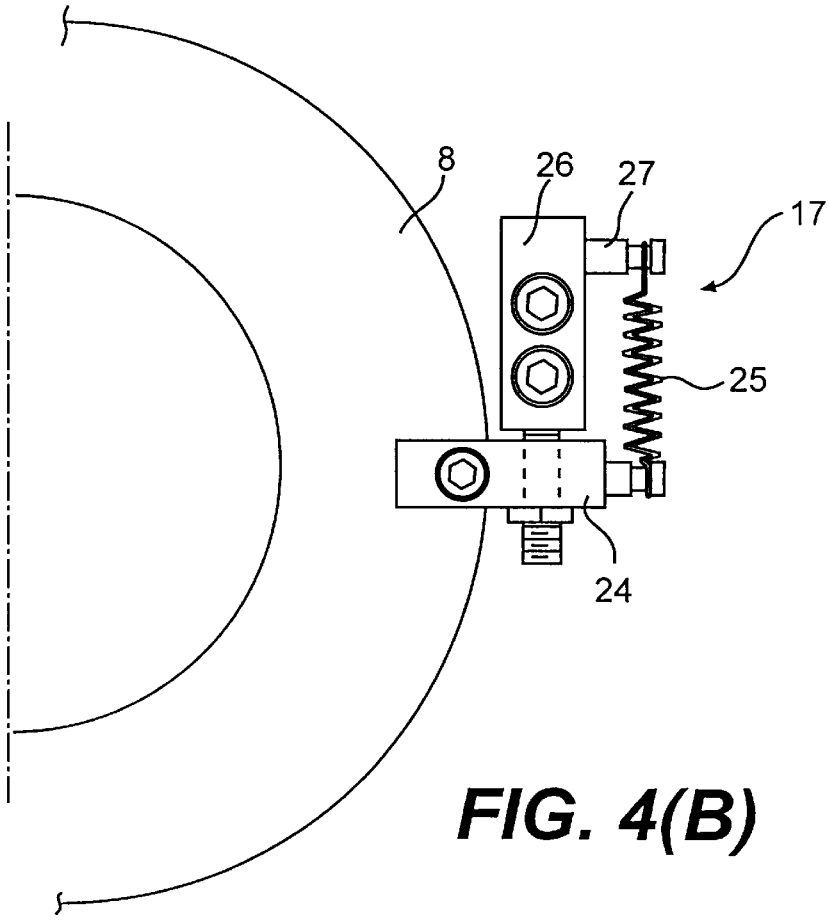

As seen in FIG. 4(A), which is a partial view in an enlarged scale of FIG. 1, and in FIG. 4(B), which is a plan view thereof, the second phase adjusting device 17 comprises an engaging piece 24 fixed on the sizing die 8, a spring 25 being engaged at an end thereof on a tip end of the engaging piece 24 to bias the latter towards the rotational direction of the sizing die 8, and a stopper means 26 is adapted to control the position of the engaging piece 24. The stopper means 26 is mounted on the die holder 5. The spring 25 is engaged at the other end thereof with a pin 27 anchored to the stopper means 26. The biasing direction of the spring 25 is set in a direction opposite to the direction of rotation of the sizing die 8 when the sizing die 8 moves downwards in order to remove the gear blank W after having finished sizing, in such a manner as described hereunder. Thus, the spring 25 serves to return the phase of the sizing die 8 to the initial position thereof when the sizing die 8 returns to its initial position after the sizing step.

The operation of the above-described sizing apparatus 1 will be explained hereunder with reference to drawings not limited to but including FIG. 5. As shown in FIGS. 1 and 5(A), the gear blank W is placed on the work set pin 11 of the second lower punch 7*b*. The work set pin 11 moves down by a predetermined stroke through the intermediary of the cylinder unit 13 so as to make the lower surface of the outer periphery of the gear blank W flush with the upper surface of the sizing die 8. At the same time, the positioning pins 12, 12 pass through the corresponding openings of the gear blank W to fix the gear blank W in position. Then, the phase of the teeth Wa of the gear blank W is registered to the phase of the inner peripheral teeth s of the sizing die 8.

Upon moving the upper plate 6 downward, the upper punch 9 presses at the lower surface thereof the upper surface of the gear blank W so as to force the gear blank W down into the inside concave portion of the sizing die 8. Thus, the tooth profile sizing of the gear blank W takes place due to the inner peripheral teeth s of the sizing die 8. As seen in FIGS. 2 and 5(B), when the gear blank W is pressed downward into the sizing die 8 up to a position such that the gear blank W is tightly held between the upper punch 9 and the lower punch 7, the sizing step is completed. During the operation as described hereinabove, since the outer peripheral teeth q of the first upper punch 9*a* are engaged with the inner peripheral teeth s of the sizing die 8, the sizing die 8, the first upper punch 9*a*, or both of them, rotate to the accompaniment of the descending movement of the upper punch 9.

During the final part of the sizing step, the outer peripheral teeth q of the upper punch 9*a* are maintained in an engaged relationship with the inner peripheral teeth s of the sizing die 8, as seen in FIG. 2. As soon as the sizing step is completed, the upper punch 9 starts moving up, and at the same time the sizing die 8 starts moving down. When the sizing die 8 is rotated in a direction so as to move downward, the first upper punch 9*a* is rotated simultaneously in the reverse direction to move upward, whereby both members 8 and 9 may be released from the gear blank W. The sized gear blank W is then removed by releasing the gear blank W from the upper punch 9 and the sizing die 8, as seen in FIG. 5(B). After removal of the gear blank W, the sizing die 8 moves upwardly to return to the initial position, and the second phase adjusting device 17 allows the phase of the sizing die 8 to be returned to the initial position. By adopting the above-described sizing process, the time required for removing the sized and finished gear blank W can be greatly reduced in comparison with the conventional apparatus, thereby improving productivity. Also, the construction of equipment for removing the gear blank W can be made more simple.

In this first embodied example, though three components comprising the first upper punch 9*a*, the sizing die 8, and the first lower punch 7*a* are formed to be rotatable, it is possible to constitute the first upper punch 9*a* as a non-rotatable member. Then, a rotatable construction is applied to the sizing die 8 and the first lower punch 7*a*. An example constructed in such a manner will be explained hereunder by way of a second embodiment.

To the second embodiment, a construction almost similar to the first embodiment is applied, except for provision in rotatable fashion of the first upper punch 9*a* and for omitting the first phase adjusting device 16. In this embodiment, the gear blank W is disposed on a second lower punch 7*b*, as seen in FIG. 6(A), and it is pressed by an upper punch 9 through its downward movement so as to be forced into a sizing die 8, as seen in FIG. 6(B). When the gear blank W is pressed down so as to be tightly held between the upper punch 9 and a lower punch 7, the sizing step of the teeth profiles of the gear blank W is carried out by the inner peripheral teeth s of the sizing die 8. During this operation, the outer peripheral teeth q of the first upper punch 9*a* come into engagement with the inner peripheral teeth s, so that the sizing die 8 rotates to the accompaniment of the descending movement of the upper punch 9. When sizing has been finished, as seen in FIG. 6(C), the sizing die 8 moves down as it rotates to be disengaged from the upper punch 9 and the gear blank W. When the sizing die 8 is disengaged from the upper punch 9, the upper punch 9 starts moving up to lie away from the gear blank W, as seen in FIG. 6(D). Herein, it can be seen that the reason why the upward movement of the upper die 9 lags behind is the lack of a rotational mechanism with respect to the upper punch 9 which engages the inner peripheral teeth s of the sizing die 8. The upward movement of the upper punch 9, therefore, is restricted until the upper punch 9 is disengaged from the inner peripheral teeth s of the sizing die 8.

As seen in FIG. 6(D), upon releasing the gear blank W from the upper die 9 and the sizing die 8, the sized gear blank W is removed.

In this second embodiment, though a little longer time for removing the gear blank W is required in comparison with the first embodiment, it is shorter than that of the conventional apparatus and the rotational mechanism for the first upper punch 9*a* is not required, so that equipment costs may be further reduced as compared to the first embodiment.

Although certain preferred embodiments of the present invention have been shown and described in detail, the invention is not limited thereto but may be otherwise variously embodied within the scope of the appended claims. It is also to be understood that any sizing art employing substantially the same construction and performing the same function to obtain the same result, therefore, will fall within the same technical scope as the claimed invention. For example, the first and second phase adjusting devices 16, 17 may be formed according to any of an air pressure control type, a hydraulic pressure control type, or a mechanical control type. The second phase adjusting device 17 may be mounted on the first lower punch 7*a* in lieu of the sizing die 8. Further, materials, shapes or the like with respect to the work set pin 11, the positioning pins 12 and the gear blank W, may be freely chosen.

As described heretofore, according to the present invention, the lower punch on which the gear blank is placed is formed comprising a rotatable first lower punch and a non-rotatable second lower punch. The gear blank is pressed by the upper punch to be forced into the rotatable sizing die. After the teeth profiles of the gear blank are sized by the inner peripheral teeth of the sizing die, the sizing die rotates and moves down so as to be disengaged from the gear blank, and the upper punch moves upwardly to be disengaged from the gear blank. Then, the gear blank becomes free and can be removed. Accordingly, an interlocking device as employed by the conventional rotary driving mechanism is not required thereby making construction simple and low-priced, and the time necessary for all steps from the sizing to the removal of the gear blank may be shortened so as to improve productivity.

In the case where the upper punch for pressing the gear blank is provided with the rotatable first upper punch as set forth hereinabove, the upward movement of the upper punch and the downward movement of the sizing die may be accomplished at the same time, following the sizing of the teeth profiles of the gear blank by the inner peripheral teeth of the sizing die. The gear blank may be removed or taken out in a short time. Furthermore, the phasing device is provided for adjustment of the relative phase between the first upper punch and the sizing die, or the relative phase between the upper punch and the first lower punch. When each of these components returns to its initial position, the phase may be adjusted to be mutually registered with each other, thereby allowing the sizing operation to be smoothly performed.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An apparatus for sizing the teeth profiles of helical gears comprising:

a lower punch on which is placed a gear blank, an upper punch being vertically movable for pressing said gear blank downward, and a sizing die adapted to have inner peripheral teeth thereof engaged with the gear blank pressed by said upper punch to size the teeth profiles of the gear blank; characterized in that said lower punch comprises a first lower punch and a second lower punch, said second lower punch non-rotationally carrying the gear blank placed thereon and said first lower punch being arranged axially rotatable around said second lower punch and provided with outer peripheral teeth thereon, said sizing die being axially rotatable and vertically movable while the inner peripheral teeth thereof are engaged with the outer peripheral teeth of said first lower punch, and said upper punch being arranged axially rotatable and provided with the outer peripheral teeth which come into engagement with the inner peripheral teeth of said sizing die.

2. A method of sizing teeth profiles of helical gears comprising the steps of:

non-rotationally positioning a gear blank carried on a lower punch, sizing the teeth profiles of the gear blank by pressing the gear blank downward with an upper punch into a sizing die while having the teeth of the gear blank and the outer peripheral teeth of said upper punch engaged with the inner peripheral teeth of said sizing die, and releasing upon termination of the sizing step said sizing die and said upper punch from engagement with the gear blank by rotating and lowering said sizing die, and moving said upper punch to remove the gear blank.

3. An apparatus for sizing the teeth profiles of helical gears comprising:

a lower punch on which is placed a gear blank, a vertically movable upper punch for pressing the gear blank downward, and a sizing die adapted to have inner peripheral teeth thereof engaged with the gear blank pressed by said upper punch to size the teeth profiles of the gear blank, characterized in that:

said lower punch comprises a first lower punch and a second lower punch, said second lower punch for non-rotationally carrying the gear blank placed thereon and said first lower punch arranged axially rotatable around said second lower punch and provided with outer peripheral teeth thereon, said sizing die being axially rotatable and vertically movable while the inner peripheral teeth thereof are engaged with the outer peripheral teeth of said first lower punch, and said upper punch comprises a non-rotationally provided second upper punch, with a first upper punch arranged axially rotatable around said second upper punch in which said first upper punch is provided with the outer peripheral teeth which come into engagement with the inner peripheral teeth of said sizing die.

4. The helical gear sizing apparatus according to claim 3, wherein a phase adjusting device is provided between said first upper punch and said sizing die or between said first upper punch and said first lower punch so as to adjust a phase therebetween when they return to their original positions.

5. A helical gear sizing method comprising the steps of:

positioning non-rotationally a gear blank carried on a lower punch, sizing teeth profiles of the gear blank by pressing the gear blank downwardly with an upper punch into a sizing die while having the teeth of the gear blank and outer peripheral teeth of said upper punch engaged with inner peripheral teeth of said sizing die, and releasing upon termination of the sizing step said upper punch and said sizing die from engagement with the gear blank while rotating said upper die and said sizing die to move said upper die upward and said sizing die downward, and removing the gear blank.

* * * * *